US007559839B2

(12) United States Patent
Bahar

(10) Patent No.: US 7,559,839 B2
(45) Date of Patent: Jul. 14, 2009

(54) METHOD AND APPARATUS FOR VERIFYING PLAYERS' BETS ON A GAMING TABLE

(76) Inventor: Reuben Bahar, 23708 Welby Way, West Hills, CA (US) 91307

( * ) Notice: Subject to any disclaimer, the term of this patent is extended or adjusted under 35 U.S.C. 154(b) by 0 days.

(21) Appl. No.: 11/373,634

(22) Filed: Mar. 9, 2006

(65) Prior Publication Data

US 2006/0202422 A1 Sep. 14, 2006

(51) Int. Cl.
*A63F 9/24* (2006.01)

(52) U.S. Cl. ..... 463/25; 273/274

(58) Field of Classification Search ..... 273/292, 273/274, 309; 463/25, 29; 473/54, 55, 106, 473/109, 125
See application file for complete search history.

(56) References Cited

U.S. PATENT DOCUMENTS 3,766,452 A * 10/1973 Burpee et al. ..... 194/214
4,948,134 A * 8/1990 Suttle et al. ..... 463/13
5,166,502 A * 11/1992 Rendleman et al. ..... 235/492
5,393,067 A * 2/1995 Paulsen et al. ..... 273/292
5,605,334 A * 2/1997 McCrea, Jr. ..... 273/309
5,651,548 A * 7/1997 French et al. ..... 463/25
5,735,742 A * 4/1998 French ..... 463/25
5,743,800 A * 4/1998 Huard et al. ..... 463/26
5,770,533 A * 6/1998 Franchi ..... 463/42
5,908,103 A * 6/1999 Dlugos ..... 194/210
5,919,090 A * 7/1999 Mothwurf ..... 463/25
6,267,671 B1 * 7/2001 Hogan ..... 463/25
6,431,984 B2 * 8/2002 Coyer et al. ..... 463/29
6,530,836 B2 * 3/2003 Soltys et al. ..... 463/29
6,532,297 B1 * 3/2003 Lindquist ..... 382/100
6,629,889 B2 * 10/2003 Mothwurf ..... 463/25
6,685,564 B2 * 2/2004 Oliver ..... 463/25
6,688,979 B2 * 2/2004 Soltys et al. ..... 463/25
7,217,135 B2 * 5/2007 Marcus et al. ..... 434/323
2006/0287066 A1 * 12/2006 Crawford et al. ..... 463/25

* cited by examiner

*Primary Examiner*—William M Pierce
(74) *Attorney, Agent, or Firm*—Cahill & Glazer P.L.C.

(57) ABSTRACT

A method and apparatus for verifying players' bets on a gaming table is comprised of a system that can detect the monetary value of a wager that is placed by a particular player at a gaming table. Once all betting is finalized, the detected monetary value of the players' bets is locked and/or recorded thereby preventing that value from being changed by the addition or removal of betting chip(s) from a player's respective bet. If after the results of the gaming round, there is a discrepancy or mismatch between a player's wager and the locked monetary value of a player's bet, casino personnel will be alerted of the player's possible cheating practices thereby enabling them to investigate the matter.

33 Claims, 11 Drawing Sheets

Black Jack Table Betting Record

55 (Table: ? )
56 (Date: Time: )
54
57

58 Betting Placement 1
- Total Bet: $5.00
- Chip Count
  Red: 1
  Green: 0
  Black: 0
  Pink: 0
* Betting Round: Won $5.00
* Total winnings/losses for betting spot: $5,300.00

59 Betting Placement 2
- Total Bet: $100.00
- Chip Count
  Red: 0
  Green: 0
  Black: 1
  Pink: 0
* Betting Round: Lost $100.00
* Total winnings/losses for betting spot: $ - 1,500.00

60 Betting Placement 3
- Total Bet: $2,050.00
- Chip Count
  Red: 0
  Green: 2
  Black: 0
  Pink: 2
* Betting Round: Won $2,050.00
* Total winnings/losses for betting spot: $12,000.00

61 Betting Placement 4
- Total Bet: $0.00
- Chip Count
  Red: 0
  Green: 0
  Black: 0
  Pink: 0

62 Betting Placement 5
- Total Bet: $10.00
- Chip Count
  Red: 2
  Green: 0
  Black: 0
  Pink: 0
* Betting Round: Won $10.00
* Total winnings/losses for betting spot: $2,460.00

FIG. 5

METHOD AND APPARATUS FOR VERIFYING PLAYERS' BETS ON A GAMING TABLE

BACKGROUND OF THE INVENTION

This invention relates to methods and apparatuses for verifying the monetary value of bets and more particularly to a method and apparatus for verifying the monetary value of bets placed on a gaming table.

Gaming casinos have played a major role in society and continues to do so today. Although most people gamble according to the rules of the casino without incident, some have worked ardently at devising cheating techniques in order to "beat the casino" and illegitimately earn profits. Despite the various cheating methods devised, some of the more costly for the casino have been the adding or removal of betting chips from a bet after the player has learned whether they have won or lost. Many cheaters using such tactics repeatedly work at improving their technique so that it is unnoticed by either the dealer or casino personnel. As has been the case, many of these players have become exceedingly tactical in their approach and as a result, have been able to cheat the casino for large amounts of money. It is mentionable that although many of these players work outside the prelude of the casino or their personnel, in some circumstances, casino dealers have been in on the "scam" and thus, have worked in partnership with the players in order to cheat the casino. Given this problem, a method and apparatus of verifying players' bets on a gaming table is required in order to curtail cheating as well as generate an accurate record of how much money a casino has taken in or paid out on its gaming tables.

BRIEF SUMMARY OF THE INVENTION

The following invention is for a method and apparatus for verifying the monetary value of players' bets on a gaming table. A detector is capable of detecting the monetary value of one or more betting chip(s) which is bet on a gaming table. The total value of the betting chip(s) bet by a player is determined by the detector and locked by the dealer once all betting is closed for any one gaming round. This will effectively prevent a player from cheating the casino by either increasing or decreasing their wager after the betting results are disclosed. Additionally, a computer system can be used to record and process the players' bets in order to allow the casino to generate an exact accounting as to how much money was won and lost from each of the respective gaming tables.

BRIEF DESCRIPTION OF THE DRAWINGS

FIG. 1' is a perspective view of one embodiment of a betting chip used on gaming tables.

FIG. 5 is a screen shot view of one embodiment of the data that can be displayed on the computer of FIG. 4.

DESCRIPTION OF THE PREFERRED EMBODIMENTS

Figure 1:
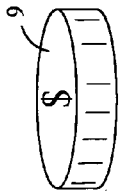
FIG. 1 is a perspective view of one embodiment of a blackjack table with five betting spots, each of which have a detector associated therewith for detecting the monetary value of a player's bet.
Figure 1:
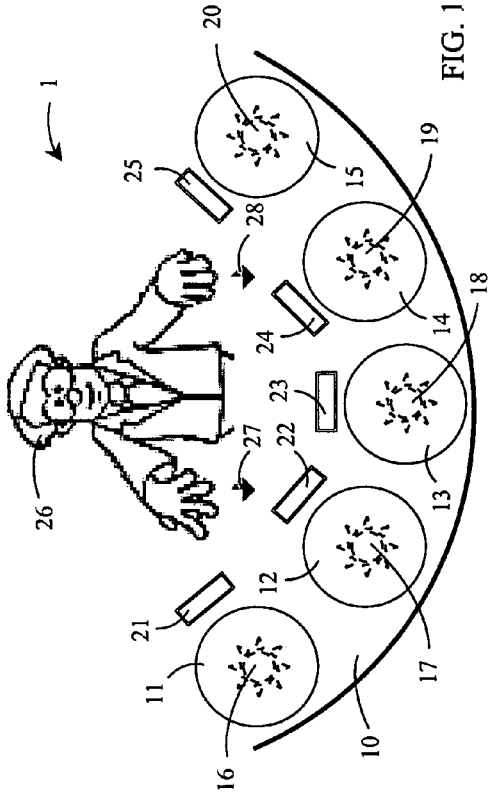

As shown in FIG. 1, one embodiment of a method and system for verifying players' bets on a gaming table is illustrated and hereinafter, referred to as the "system" 1. As illustrated in FIG. 1, system 1 is made up of a blackjack table 10 which has five betting spots 11, 12, 13, 14, & 15, each of which have a betting chip detector, respectively numbered 16-20, and LCD, respectively numbered 21-25, associated therewith. Although each of the betting spots 11-15 has its individual detector, 16-20 respectively, it is likewise contemplated that one detector can be used for all of the betting spots 11-15. Additionally, although each of the detectors 16-20 is shown to be located underneath the betting spots 11-15 respectively, the detector(s) can likewise be located in any location that would allow them to detect the total monetary value of each bet placed in a respective betting spot 11-15. As such, detectors 16-20 may be located on top or even above blackjack table 10. It should further be noted that despite the system 1 components mentioned above, the system may further include, but is not limited to a computer, a CPU, a data storage element, and program modules which will allow the method and apparatus to function in accordance with the invention described herein.

Detectors 16-20 can comprise of any device that is capable of detecting the monetary value of a given betting chip(s) 9, as is shown in FIG. 1', that is placed within their range of detection. As used in the specifications and claims, the term "betting chip" 9 refers to any object, regardless of its composition that has a determined monetary value and which is used for placing wagers on a gaming table. The term is further meant to include legal currency in both paper and coin form. As typically seen in most gaming casinos, a betting chip 9 is rendered in the form of a circular coin-like object that is composed of plastic material and has a set monetary value.

The betting chip detector(s) include both electronic as well as non-electronic devices, the determination of which is best know to those skilled in the art. In this sense, each of the detectors 16-20 will be able to distinguish between individual betting chips, regardless if their stated monetary value is the same or different. This can be done by configuring the detectors 16-20 to recognize the distinctive characteristic(s) of each betting chip that is placed within its range of detection. For example, betting chips of a particular monetary value may have within them a particular kind of metallic element which is detectable by each of the detectors 16-20. Thus, if a $5.00 betting chip has copper imbedded within it, while a $100.00 betting chip has silver embedded within it, a detector that is able to distinguish between both will be able to ascertain the presence of a $5.00 as well as $100.00 betting chip when they are placed within its detection range.

Preferably, the detector 16-20 will likewise be able to recognize repetitive occurrences wherein two or more betting chips of the same monetary value are placed within its detection range. Thus, for example, when two $5.00 betting chips are placed within the detection range of one of the five detectors 16-20 the respective detector will be able to ascertain the presence of both $5.00 betting chips. One way of accomplishing this is to configure the detector to be sensitive to quantity measurements (for detecting repetitive occurrences) as well as characteristic qualities (for distinguishing between the value of different betting chips). For example, distinctions based on quantity measurements can be based on simply detecting each separate occurrence of a particular event (such as the addition of another chip of the same kind and value). This can include recognition of same value betting chips on account of weight measurements wherein only similar betting chips weigh the same. Thus, if a $5.00 betting chip weighs 2.3 ounces, while a $25.00 betting chip weighs 3.4 ounces, a weight measurement of 4.6 ounces (which would be the total weight of 2 $5.00 betting chips) would indicate a presence of 2 $5.00 betting chips. Of course, such a scheme would require the use of a weight measuring device that is a part of or separate from the detector 16-20. Furthermore, distinctions based on quantity measurements can also be done by configuring each betting chip with a unique identification element (such as a code), and identifying it on a separate basis. It is noteworthy that despite the methods mentioned herein, several other methods of distinguishing between repetitive occurrences of the same betting chip may exist which are best known to those skilled in the arts and thus, need not be elaborated upon herein.

It is noteworthy that the betting chips themselves may contain any element/material that will allow them to be detected and recognized by the detector (e.g. 16). Possible elements/materials can include, but are not limited to metals, chemicals, plastics, printed matter, magnetic field, optics, etc. This furthermore includes any electronic mechanism within the betting chips that will allow them to be detected and recognized by the detector (e.g. 16). For example, each betting chip can have within it, an embedded transmitter (such as a radio frequency transmitter) which will emit a unique signal to the detector (e.g. 16), thereby allowing it to ascertain the presence and value of the particular betting chip within its detection range. Additionally, distinguishing characteristics may further include printed matter on the betting chip such as a particular code or color scheme (as is often located on the face and around the edges of many betting chips). It is further contemplated that betting chips may be placed inside the detector in order for their value and presence to be acknowledged. This scenario, of course, would require that the detector (e.g. 16-20) be situated in a vicinity (such as on top of the gaming table) which allows a player ready access to it. Despite the mentioned methods of allowing the betting chip to be identified and distinguished by the detector (e.g. 16-20), other methods which are best known to those skilled in the art may likewise exist, and thus, need not be elaborated upon herein.

It should furthermore be mentioned that where more then one detector is utilized per gaming table, it is preferred that each such detector (e.g. 16-20) have a limited detection range that will limit its detection abilities to a predetermined vicinity. This will ensure that a detector designated to detect betting chips in a particular betting spot will not detect betting chips in adjacent betting spots. In other words, with reference to FIG. 1, detector 16 which is configured to detect betting chips in betting spot 11 will not detect any betting chips that are placed in betting spot 12. This will ensure that the detector 16 that accounts the total monetary value of the bet for the player positioned in betting spot 11 will not improperly take into account the monetary value of any of the betting chips placed in any of betting spots 12-15.

Figure 11:
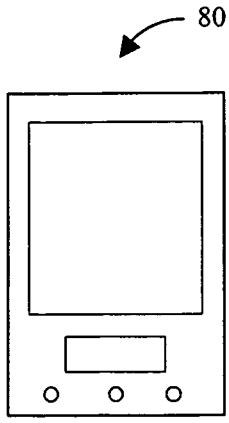
FIG. 11 is a perspective view of a hand held computer.
Figure 14:
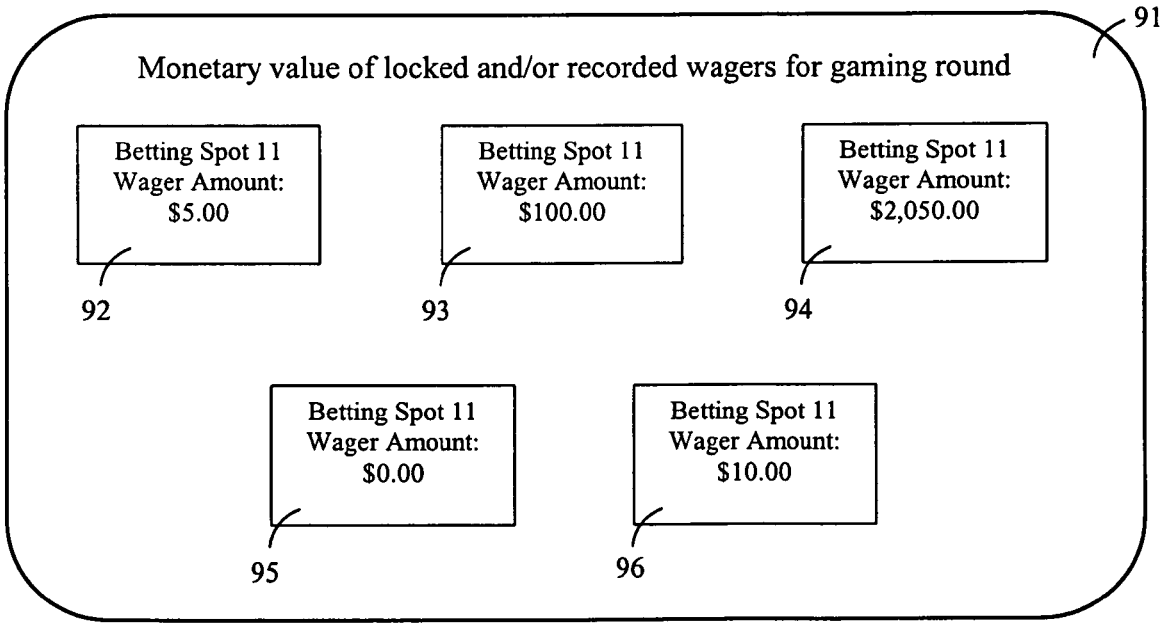
FIG. 14 is a computer screen view of the locked wagers made on the blackjack table of FIG. 1.

Prior to the beginning of a gaming round for any game of chance, the respective players are allocated a certain amount of time in which to place their desired monetary bets, hereinafter referred to as, "betting time". Once this is done, the betting time is closed and players are no longer allowed to change their bets. At this point, the casino game handler or dealer will lock the monetary value of the bets for each respective player, as detected by the respective detectors. Locking of a player's wager will freeze the locked monetary value and constitute that amount as the player's bet for the gaming round. This means that once a bet is locked, the detector will not change the monetary value of the bet in the player's betting spot regardless if betting chips are removed from or added to that betting spot. Once locked, the value of the players' bets will be made known to the dealer 26 by any method known to those skilled in the art which may include a computer kept in the possession of the dealer 26, LCDs on the gaming table, or a combination of the two. A computer kept in the possession of the dealer 26, for example, may be a stationary computer, ref. character 53, FIG. 4, or handheld computer (i.e. Palm Pilot®, PC, etc.), ref. character 80, FIG. 11. As shown in FIG. 14, this computer can display the locked and/or recorded value of the respective players' bets after bets for the particular gaming round are made final by the dealer. There, a computer screen 91 (which can pertain to a stationary computer 53, FIG. 4 or handheld computer 80, FIG. 8), indicates that the player in betting spot 11 has wagered $5.00, ref. char. 92; the player in betting spot 12 has wagered $100.00, ref. char. 93; the player in betting spot 13 has wagered $2,050.00, ref. char. 94, the player in betting spot 14 (if actually present) has wagered $0.00, ref. char. 95; and the player in betting spot 15 has wagered $10.00, ref. char. 96. Assuming that the locked value of the players' bets is provided to the dealer 26 on a computer kept in their possession, it would further be preferred that this value be displayed on LCD screens such as those indicated by reference characters 21-25, FIG. 1. This will allow each player to view their locked bet as well as provide the dealer with an additional visual source that displays the locked value of the players' bets. The result of this would allows the dealer to monitor any of the players' attempts to illicitly change their bets and cheat the casino. Additionally, the players themselves would be reluctant to attempt any deceitful tactics in light of the display of the locked value of their bets. In the event that there is a discrepancy or mismatch between a player's wager and the locked monetary value of a player's bet, the casino personnel (e.g. the table dealer and/or other casino operations staff) will be alerted of the player's possible cheating practices thereby enabling them to investigate the matter. Alerting of the possible fraud may be accomplished via a warning signal that is outputted by the system 1. The warning signal may be visual (as would be if presented on a computer screen), audible, or a combination of the two.

With regards to FIG. 1, once the betting time for the gaming round is closed, the dealer 26 of blackjack table 10 will lock the value of the wagers bet by each player. This may be done by any method known to those skilled in the art, including the pushing of a button 27 as shown in FIG. 1. This will lock and/or record the total monetary value of all of the detected betting chips for each of the betting spots 11-20. At this point, any change in the monetary value of a player's wager will not be registered and/or detected by the betting spot detector(s) 16-20. The result is that should a player illicitly attempt to change their wager before or after the game results are in (or at any unauthorized time during the gaming round), the monetary value of the betting chip(s) 9 located in the player's betting spot 11-15 respectively, will not correlate to the locked monetary value displayed on the player's respective LCD (i.e. LCDs 21-25), or on the dealer's computer, FIG. 4, ref. character 53 or FIG. 11, reference character 80. When the dealer attempts to either pay the player (for a winning hand)or take their wager (for a loosing hand), the dealer will become aware of the discrepancy or mismatch between the player's wager and the locked monetary value of the player's bet. This will put the casino on alert of the player's possible cheating practices thereby enabling them to investigate the matter.

Figure 4:
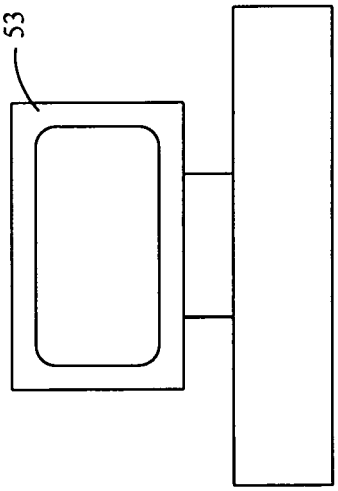
FIG. 4 is a perspective view one embodiment of a computer which can be used to display the details of the total monetary value of players' bets for respective gaming tables.

It should further be mentioned that in addition to being displayed to the dealer, the locked value of each of the player's wagers can be processed and/or stored in one or more computer system(s), as exemplified by the computer reference character 53, FIG. 4. This will enable the casino to electronically monitor the course of the particular game. Should a player attempt to illicitly change their bet during the course of the gaming round, the increase or decrease in the value of the particular player's bet will be detected by the respective detector 16-20 and communicated to the computer system 53. Although the locked value of the players' monetary wager will not change, the computer 53 will be able to detect the addition or removal of betting chips from the respective betting spot(s) 11-15 and alert casino personnel of the incident. In addition, processing and/or storing the locked value of each player's wager will allow the casino to get an accounting of the total winnings and losses of a particular gaming table, as will be discussed in detail later on. It is noteworthy that whether betting chips 9 may be added or removed from a finalized wager is often dependent on the rules of the game that is played, however, typically, doing such is not allowed from the period in which the betting time for a particular gaming round has ended to the time in which the gaming round has ended. As mentioned, however, there are exceptions to this rule, such as is the case with the game of blackjack which allows for bet adding or removal of betting chips 9 during instances of doubling down, splitting of the hand, and taking of insurance. Other games likewise, may have similar exceptions depending on their rules manner in which they are run by the casino.

Figure 2:
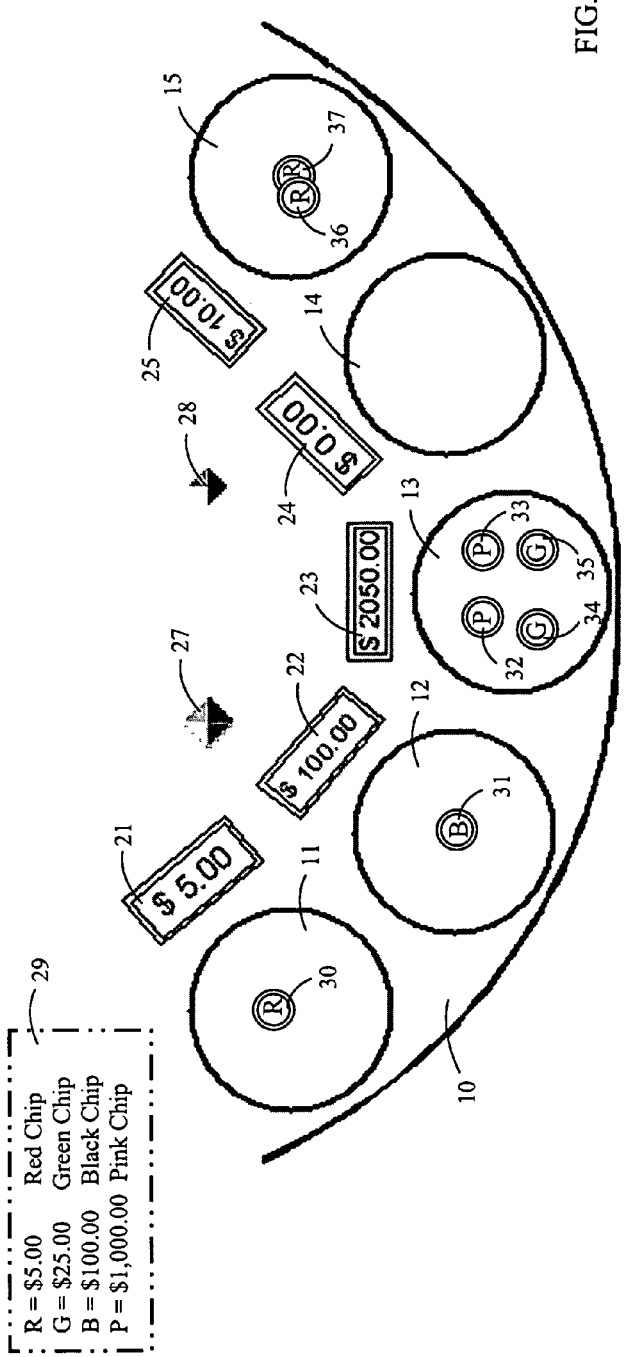
FIG. 2 is a perspective view of the blackjack table of FIG. 1 wherein the total monetary value placed on each of the five betting spots is disclosed on adjacent LCD screens.

Referring to FIG. 2, blackjack table 10 is shown with betting chips being placed on four out of the five betting spots 11-15. As indicated by chart 29 of FIG. 2, each Red betting chip is valued at $5.00, each Green betting chip is valued at $25.00, each Black betting chip is valued at $100.00, and each Pink betting chip is valued at $1,000.00. Thus, when a Red betting chip 30 is placed in betting spot 11, LCD 21 displays a sum of $5.00 which is the total monetary value of the entire bet placed in betting spot 11. This is made possible by the use of detector 16 which, as illustrated in FIG. 1, is located under betting spot 11, and is capable of recognizing the quantity and value of all of the betting chips placed inside betting spot 11. Similarly, a Black betting chip 31 is placed into betting spot 12 and is detected by detector 17, thereby displaying a total value of $100.00 in LCD 22. Next, betting spot 13 contains four separate betting chips which are spread out and consist of two Pink betting chips, 32 and 33 respectively, as well as two Green betting chips, 34 and 35 respectively. Since the detector 18 is able to distinguish between betting chips of different value (e.g. Pink and Green as shown here) as well as identify two or more of the same betting chip (e.g. two Pink or two Green as shown here), a total monetary value of $2,050.00 is displayed on LCD 23. Conversely, in situations where there are no betting chips inside the betting spot, as is the case with betting spot 14, the detector 19 will likewise indicate a total monetary value for the bet (which in this case is $0.00), and display it on the LCD 24. Finally, in betting spot 15, two Red betting chips 36 and 37 are shown stacked on top of each other. Here, the detector 20 is likewise able to detect the presence of both of these betting chips and instructs the corresponding LCD 25 to show a total monetary value of $10.00. It is noteworthy that the detector (e.g. 16-20) will be able to detect the presence of betting chips regardless of how they are placed and positioned inside their respective betting spot. In other words, regardless if the betting chips are spread out in the betting spot (as is shown in FIG. 2, betting spot 12) or stacked atop of one another in the betting spot (as shown in FIG. 2, betting spot 15), the detector will nevertheless, detect them and ascertain their cumulative value. This is because the detector's ability to detect repetitive occurrences (wherein two or more betting chips of the same monetary value are placed within its detection range) is independent of how those betting chips are placed or positioned inside the betting spot.

In using FIG. 2 to illustrate how a blackjack hand would be dealt from start to finish, we would first assume that the monetary value of each bet shown in the respective LCDs 21-25 represent the final bets for this particular hand as made by the players corresponding to betting spots 11-15. At this point, the betting time for the gaming round would be closed, thereby preventing the players from increasing or decreasing their bet. As a consequence, the dealer 26 would lock and/or record the total monetary value of each of the bets located in betting spots 11-15 respectively, by pushing button 27. It is noteworthy that in addition to pushing button 27, several other methods which are best known to those skilled in the arts may exist for locking and/or recording the total monetary value of each bet in betting spots 11-15, and thus, need not be elaborated upon herein. From this pint, the dealer 26 would deal each player their blackjack hand and play them through. Since each bet corresponding to betting spots 11-15 was locked and/or recorded and subsequently displayed on LCD 21-25 prior to any cards being dealt, the dealer 26 would be able to verify the total monetary value of each bet placed in the betting spot 11-15. This would effectively prevent any player from secretly adding or removing betting chips from their original bet during the course of the game and/or after they are aware of whether they won or lost the blackjack hand as the dealer 26 would always know how much money is due to or from each player corresponding to their respective betting spots 11-15. As previously mentioned, once the dealer locks and/or records the players' wagers, the detector 16-20 corresponding to their betting spot 11-15 the locked value displayed ion the respective LCDs 21-25 will not change despite the detector having detected additional or fewer betting chips 9 prior to the end of the gaming round. For example, if the player associated with betting spot 13 lost the hand and, unbeknown to the dealer 26, secretly took back one of their Pink $1,000.00 betting chips (e.g. 34), the dealer 26, despite not having seen the chip being removed, would nevertheless know that a Pink betting chip was removed and that the casino is due an additional $1,000.00 from the player in betting spot 13. This is because LCD 23 would indicate a total bet value of $2,050.00, while the total monetary value of all betting chips in betting spot 13 would be $1050.00. In this manner, players as well as accomplice dealers will effectively be stopped from cheating the casino. It is noteworthy that once the dealer 26 has finished paying out or collecting on won or lost bets in betting spots 11-15, they would preferably clear the monetary sum displayed on LCDs 21-25 in order to initiate a new gaming round. Clearing of LCDs 21-25 can be done by depressing button 28 located on table 10 or any other preferred method known by those skilled in the art. Once this is done, the monetary values displayed on LCDs 21-25, or the dealer's computer 53, FIG. 4, 80, FIG. 11 will be released or unlocked, thereby reverting to zero and thereafter, displaying the value of the players' subsequent wagers for the next gaming round.

With regards to the game of Blackjack and other similar type gaming, a player may sometimes be allowed to increase or decrease their wagers during the commencement of the game and prior to the win loss outcome becoming known. In Blackjack, for example, such a scenario may occur when the player decides to double down, split, or take insurance on their hand. Since the players' wagers will be locked at this point in the game, the dealer 26 may initiate an override function which will allow the detected monetary value of the particular player's bet to be adjusted accordingly. This can be done in a number of ways which include the use and/or initiation of a program sequence as well as simply releasing/unlocking of the monetary value of a particular player's bet.

Figure 12:
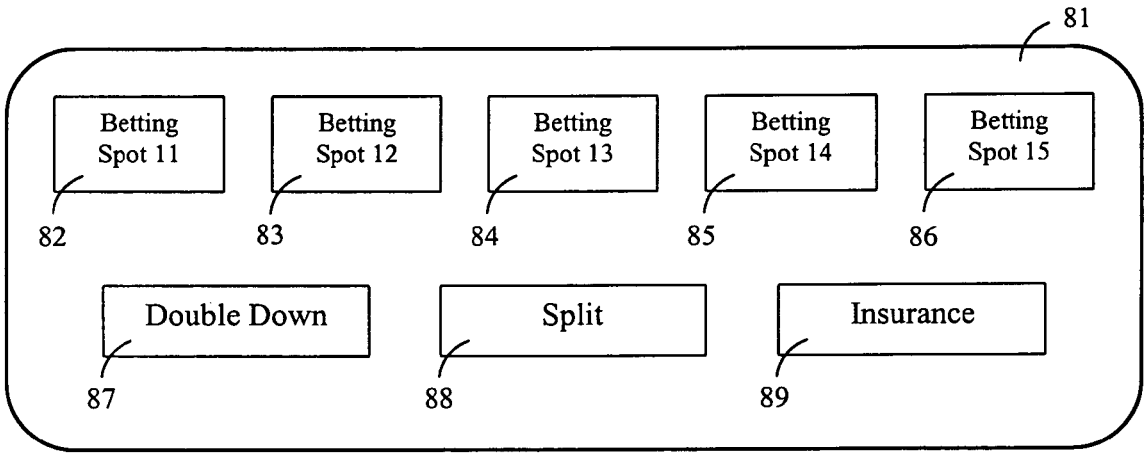
FIG. 12 is a computer screen view of one embodiment of various program sequences that can be initiated for the blackjack table of FIG. 1.
Figure 13:
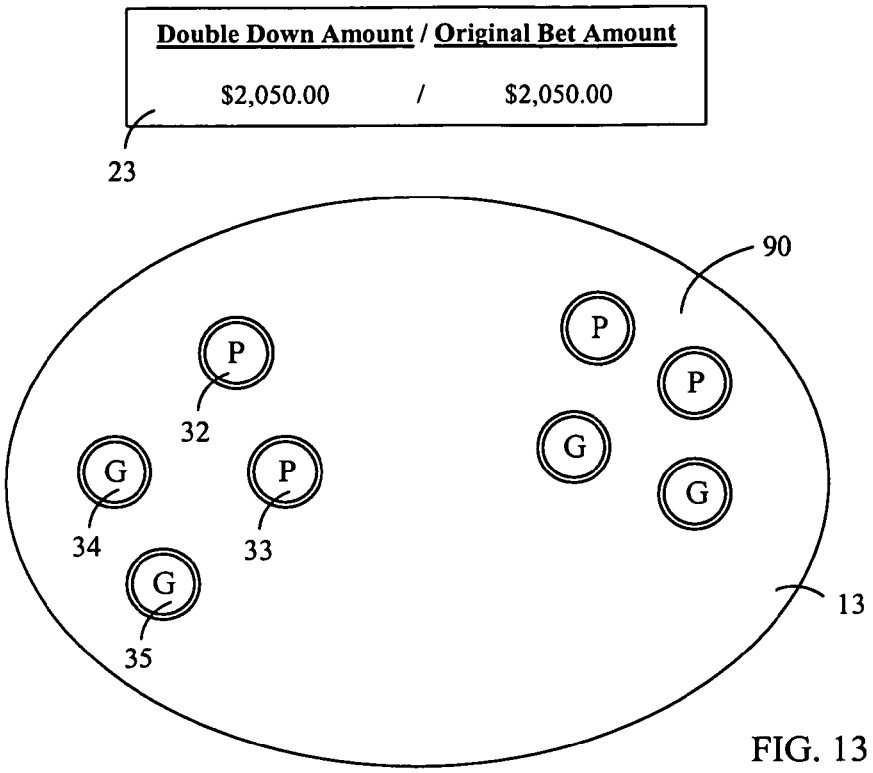
FIG. 13 is a perspective view of one embodiment of a double down program sequence initiated for betting spot 13 of the blackjack table of FIG. 1.

The first method which involves input of program sequence would allow the dealer 26 to activate a program command(s) that would direct the respective LCD 21-25 or dealer's computer 53, 80 to operate in a particular sequence. The particular type of program sequence as well as the functions it will perform will vary from depending on the game table and required functionality and thus, may best be determined by those skilled in the art or casino personnel. For example, if the particular player wanted to double down on their hand, the dealer 26 may activate a "double down" program sequence for that particular player which would unlock the monetary value indicated on the player's betting spot LCD (or on the dealer's 26 computer 53, 80) and allow for the recognization and/or recording of additional betting chips 9 which would be added to the original wager. According to one embodiment, and as shown in FIG. 12, the dealer 26 may turn to their computer 53, 80, select the particular player or betting spot 82-86 from the menu and indicate the desired program sequence to initiate 87-89. Thus, as shown in FIG. 13, if the player corresponding to betting spot 13 of FIG. 2 wanted to double down, the dealer 26 may turn to their computer 53, 80, press button no. 84 (which may be manual or touch screen), FIG. 12 (which pertains to betting spot 13), and thereafter, button no. 87, FIG. 12 which initiates the "double down" program sequence for betting spot 13. Thereafter, the player occupying betting spot 13 would be required to place an additional $2,050.00 in chips, collectively referenced by character 90, wherein after, the detector 18 would register and/or record (on the respective LCD 23 or dealer's 26 computer 53, 80) the additional $2,050.00 which the player added. As shown in this example, the "double down" program sequence may be specifically programmed to allow for an additional amount of betting chips 9 with a value that is exactly equal to that of the player's original bet; any betting chip 9 value that is different from the original bet amount will initiate a warning alert from the system 1 and/or any of its components such as the respective player's LCD or dealer's computer 53, 80. Thus, after the additional chips are detected and accepted on the LCD 23 or dealer's computer 53, 80, the adjusted monetary value may once again be locked and/or recorded (either automatically by the system or manually by the dealer's 26 actions such as pressing of button 27). It is noteworthy that where the dealer 26 inputs a program sequence, the system 1 will react in accordance with that particular program sequence. Thus, if the program sequence pertains to doubling down ref. character 87, FIG. 12 (in blackjack), the system will expect that the player's original bet be doubled (as just indicated in the example above) and not allow for an alternative variation of wagering. If, on the other hand, the program sequence pertained to splitting of cards, ref. character 88, FIG. 12, the system 1 would expect that the player's original bet be doubled as well as allow for another incidence for splitting of the hand or doubling down. Additionally, if the player took insurance and lost, the insurance program sequence, noted by ref. character 89, FIG. 12, would allow the dealer to take one half of the player's bet, and thereafter, allow the monetary value of the player's bet to be adjusted on the LCD 23 or dealer's computer 53, 80. As mentioned above, the program sequence can be initiated by the dealer 26 through any number of methods including activation from the dealer's computer 53, 80 (which would be linked or networked to the system 1) and/or activation by pressing a designated button(s) on the gaming table 10, similar to buttons 27 and 28. Despite these two examples, similar methods for initiating the program sequence and which are best known to those skilled in the art may likewise exist and need not be elaborated upon herein.

According to another embodiment, the dealer 26 may override the lock on a particular player's wager (without activating a program sequence) simply by releasing/unlocking the particular wager. This likewise may be initiated in circumstances where the game allows the player to increase or decrease their bet during the commencement of the gamming round (e.g. during an action to double down, split, or take insurance on the hand). Overriding the lock on a particular player's wager may be accomplished by pressing a release button similar to button 28 in FIG. 1 which will allow the detected monetary value of the particular player's bet to be adjusted accordingly. After the particular player's bet is released, the dealer 26 may conduct particular player's gaming round in accordance with the player's decisions (e.g. double down, split, insurance on player hand) and initiate a re-lock of the final wager value once the player's wager has been adjusted in accordance with those decisions.

Figure 3:
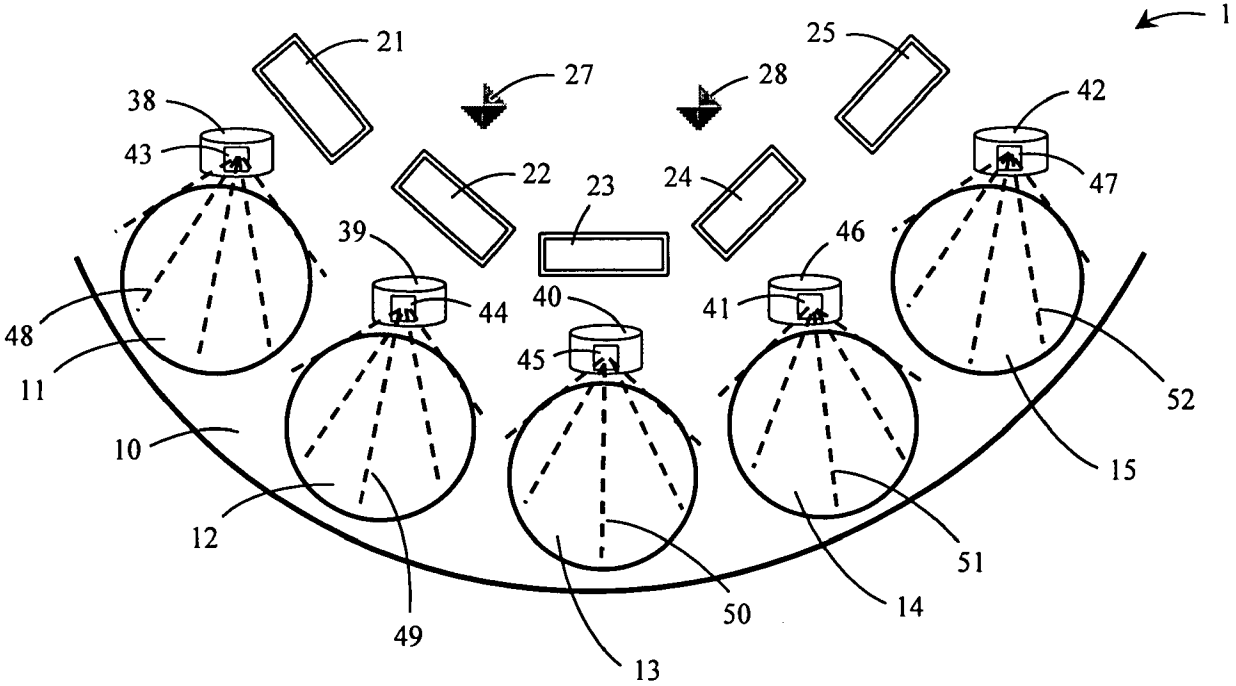
FIG. 3 is a perspective view of the blackjack table of FIG. 1 wherein each of the five betting spots is associated with a scanner for determining the total monetary value of a player's bet.

Referring now to FIG. 3, blackjack table 10 is shown in an alternative configuration wherein scanners 38-42 have replaced detectors 16-20 as the mechanism for determining the total monetary value of the bet in each of the betting spots 11-15. As shown, each of the scanners 38-42 are located on top of blackjack table 10 and have a scanning eye referenced 43-47 respectively. Similar to detectors 16-20, however, scanners 38-42 may likewise, be situated in any location, whether above or below the gaming table, that will allow them to accurately determine and identify the total monetary value of the betting chips in a particular betting spot. In this manner, any betting chips placed in any of the betting spots 11-15 will be scanned by scan beams 48-52 respectively in order to determine their total monetary value. It is noteworthy that scanners 38-42 can identify a betting chip and distinguish it from others by scanning for unique characteristics pertaining to the scanned betting chips. As previously mentioned, such characteristics may include a distinct type of element/material such as metal, chemical, plastic compound, or electronic device that is embedded in each betting chip. Additionally, distinguishing characteristics may further include printed matter on the betting chip such as a particular code or color scheme (as is often located on the face and around the edges of most betting chip). It is further contemplated that betting chips may be placed inside the detector (such as a chip tray that can detect the monetary value of betting chips 9) in order for their value and presence to be acknowledged. It should be mentioned that despite the mentioned methods of allowing the betting chips to be identified and distinguished by the scanner (e.g. 38-42), other methods which are best known to those skilled in the art may likewise exist, and thus, need not be elaborated upon herein.

As previously mentioned, in addition to aiding the table dealer run the gaming rounds and monitor players' attempts to cheat the casino (at a particular gaming table), one or more computers such as computer 53 can likewise be used to compile statistics about the betting activity of the respective players' at a particular gaming table. These computer(s) 53 may be set up to receive data from the gaming table(s) in reference to the bets made by players at a particular gaming table, casino winnings and losses at a particular gaming table, and cumulative casino winnings and losses at two or more gaming tables. It is noteworthy that computer(s) 53 set up to compile statistics about the betting activity of in the casino may be located at a central monitoring station either within or outside of the casino. Furthermore, this computer(s) 53 may be separate and distinct or one and the same from the computer 53, 80 used by the dealer to monitor player betting activity. Assuming that the dealer's computer 53, 80 is separate from the casino central computer(s) 53, it is likewise contemplated that both may be networked to one another so as to enable communication and data sharing between them. Statistical data received from the gaming table(s) can include, but is not limited to the following: 1) the monetary value of each wager made at a particular gaming table, 2) frequency of wagering at the particular gaming table, 3) winnings realized at a particular gaming table, losses realized by a particular gaming table, 4) frequency of attempts to cheat at a particular gaming table (as would be noted if there was a discrepancy or mismatch between the total monetary value of all betting chips in a particular betting spot and the locked monetary value of a player's bet during a gaming round), 5) operation/functionality of the game table system 1, etc. Received data can thereafter be compiled to generate any of the desired information as noted above.

For example, if the casino wanted to compile a real time or dated record of the day's winnings and losses of all of the bets made at a given gaming table, they may utilize computer 53 in the following manner. First, the computer(s) 53 would collect data from a particular gaming table which would relate to the wagering activity taking place during each gaming round at that table. Data derived from a gaming round can consist of, but is not limited to total monetary value of each bet placed in a particular betting spot per gaming round, total monetary value of all bets placed on the gaming table per gaming round, breakup of the betting chips associated with each particular betting spot, time of bet, date of bet, name and identification information of a particular player at a particular betting spot, gaming table identification number, total revenue or loss that was due to or won from the casino from all bets made on a particular or all gaming tables that utilize the invention disclosed herein, etc. Such data could be tallied up at predetermined time intervals (whether in real time, periodically, or in accordance with a set schedule) in order to give the casino an accounting of how much money was won or lost at a particular gaming table. Most of the data pertaining to the value of wagers made at a particular betting spot 11-20 could be manually or automatically inputted into the casino computer 53 (as will be further discussed later on). With regards to whether a particular player won or lost on a particular gaming round (e.g. the blackjack hand), such data can likewise be manually inputted into the casino computer 53 (e.g. via the dealer's computer 53, 80) or automatically inputted into the casino computer 53 via electronic methods best known to those skilled in the art. Such electronic methods may consist of the use of sensors, card readers, video equipment, imagery technology, etc.

After such statistical information is collected and inputted into the casino central computer 53, the casino can thereafter process the data in order to attain a complete and correct accounting as to the cumulative profits or losses at any one, few, or all gaming tables (that utilize the method and system disclosed herein) within a particular time period. The ability to accurately account for the winnings and losses of any particular gaming table will further enable the casino to monitor the performance of their table runner (e.g. dealer 26) and whether they may be involved in a scheme to cheat the casino.

As previously mentioned, recorded accounting data derived from each table (e.g. identification and accounting of the locked value of the betting chips wagered on the game table or whether a particular player won or lost on a particular gaming round) can be inputted into computer 53 in a number of different ways, which are not limited to, but include the following methods. A first method would require that the data be compiled and collected from each gaming table and thereafter, manually inputted by casino personnel into computer 53. Compilation and collection of the data can be done at any desired time interval during the gaming process and manual input of the data into casino computer 53 can likewise be done at any time interval, such as at the end of each work day. A second method would allow the data derived from each gaming table to be automatically uploaded/inputted into computer 53. Automatic input would allow data that is determined by the system 1 and/or any other electronic devices (such as the value of the betting chips which is detected and recorded by the system 1 or data indicating whether a particular player won or lost on a particular gaming round) to be communicated by the system 1 to the casino computer 53. An increase or decrease in a player's wager during the commencement of the game (as per initiation of a program sequence mentioned above) would likewise result in data that could automatically be detected by the system 1 and communicated to casino computer 53. Uploading of data to computer 53 can likewise occur at any predetermined time interval, but would preferably occur on a real time basis. This way, casino personnel would be able to monitor intake and payouts of respective gaming tables in the casino and immediately investigate any suspect situation. It is noteworthy that casino computer 53 can receive data from the gaming tables by either having it manually inputted into it (by authorized personnel), or automatically uploaded to it via a direct connection to the gaming tables which utilizes either a wired or wireless connection.

One embodiment of the data that can be displayed on the computer 53 of FIG. 4 can be seen in FIG. 5. There, a betting record 54 is shown pertaining to blackjack table 10 of FIG. 2, reference character 55. In addition to indicating the particular gaming table, the record 54 also indicates the date 56 (Feb. 20, 2005) and time 57 (11:05 PM and 10 sec.) of the particular gaming round after the time at which further betting ceased and bets made were recorded and locked. In other words, the record 54 reflects the moment after no further changes in betting was allowed and prior to the dealing of any hand. As shown, the record 54 displays a detailed accounting as to the total monetary value of the betting chips placed in all betting spots numbered 11-15 respectively. To this effect, record 54 indicates that betting spot 11, reference character 58, has a total bet amount of $5.00 consisting of 1 Red betting chip; betting spot 12, reference character 59, has a total bet amount of $100.00 consisting of 1 Black betting chip; betting spot 13, reference character 60, has a total bet amount of $2,050.00 consisting of 2 Pink and 2 Green betting chips; betting spot 14, reference character 61, has a total bet amount of $0.00 consisting of no betting chips; and finally, betting spot 15, reference character 62, has a total bet amount of $10.00 consisting of 2 Red betting chips. To this record 54, the additional information as to whether a particular player at a particular betting spot 11-15 had won or lost their wager at the end of the particular gaming round. This data can likewise include the total amount of winnings or losses realized during the particular gaming round (as shown in FIG. 5, ref. characters 58-62 respectively) as well as the total winnings or losses realized by a particular player from the time that they occupied a particular betting spot to the time that they left it (not shown). The betting record 54 can further contain a total sum of the winnings or losses at a particular gaming table betting spot 11-15 (see FIG. 5, ref. characters 58-62) that was realized throughout the course of the day, week, month, etc. It is noteworthy that besides compiling of statistics regarding the gaming activity, if, at any point during a gaming round, the casino central monitoring computer 53 detects a discrepancy or mismatch between the total monetary value of all betting chips in a particular betting spot 11-15 and the locked monetary value of a player's bet during a gaming round, a warning signal may be generated, in real time, which alerts casino personnel (apart from the dealer) that a player may be attempting to cheat the casino. As previously mentioned, the warning signal may be visual, audible, or a combination of the two.

Although most of the discussion thus far has focused on the game of blackjack (as per FIGS. 1, 2, and 3, reference character 10) to illustrate the invention, it is likewise contemplated that method and apparatus for verifying player's bets on a gaming table may likewise be utilized with gaming tables other then blackjack. To this effect, the detectors discussed above as well as ones which will be discussed below and the like, may likewise be used with all other gaming tables. Such gaming tables would include, but are not limited to roulette, craps, poker (e.g. pai-gow), baccarat, casino war, let-it-ride, wheel of fortune, etc.

Figure 6:
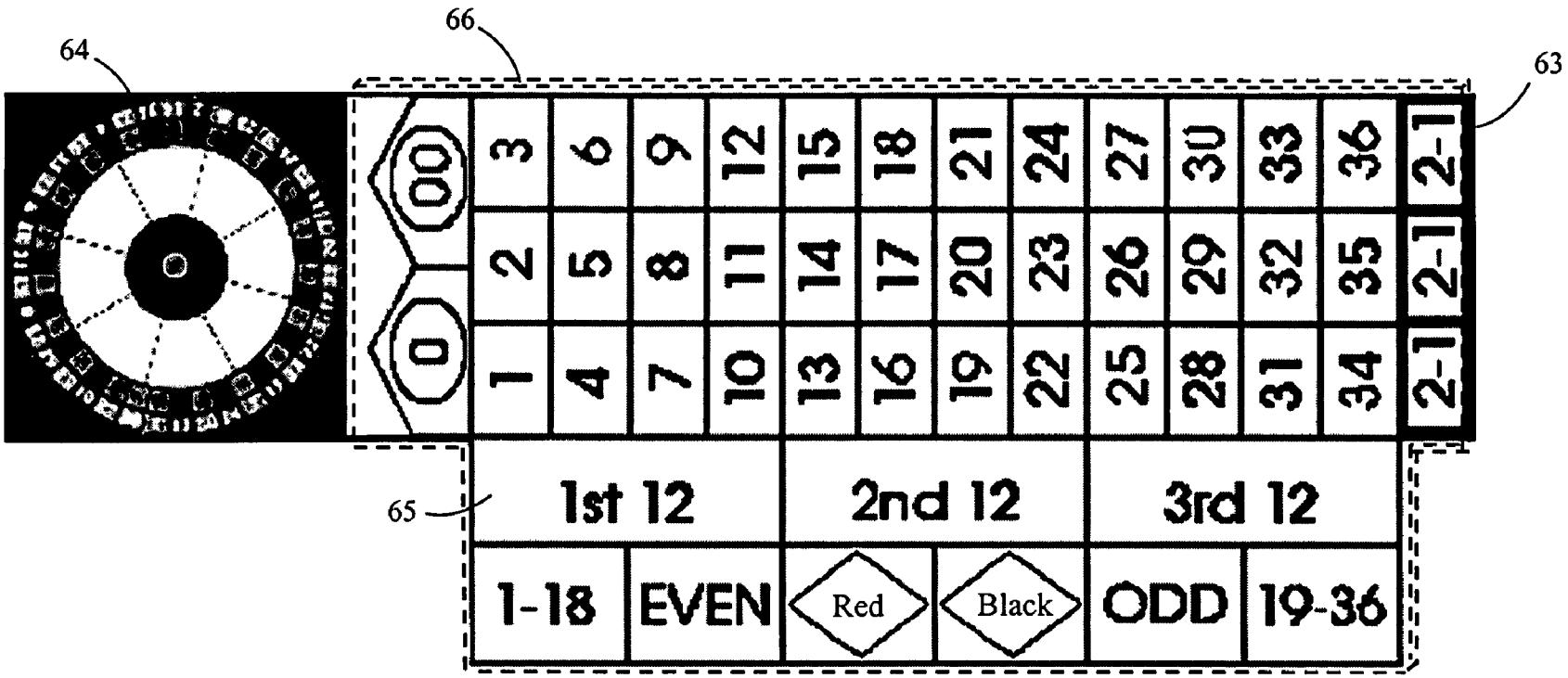
FIG. 6 is perspective view of a roulette table with a detector located underneath.

With specific regard to gaming tables, such as roulette and craps that simultaneously allow for a multiplicity of distinct bets during a single gaming round, either one or a multitude of independent detectors may be used. Whichever is the case, it is preferred that the detector(s) be able to pinpoint the exact positioning of the bets placed on the gaming table and more particularly, the location of the betting spots, along with the total monetary value of each bet. For example as shown in FIG. 6, a roulette table 63 which has a spin wheel 64 and a betting board containing a multiplicity of sectioned betting spots 65, may utilize a single and uniform detector 66 in order to accurately identify the betting chips and their position on the gaming board. The ability to accurately determine the positioning of the betting chips is crucial in games such as roulette since their positioning on the game board often determines the parameters of a player's bet and financial payout if they win. For example, if a player was to place a $20.00 bet on the cross sections of betting spot numbers 4, 5, 7, and 8 located on the roulette betting board 65, having the marble land on any one of these numbers would result in a $9.00 payout if the player bet $1.00. However, if the same $1.00 bet was placed solely within the borders of betting spot number 5, a payout would only be won if the marble landed on betting spot number 5. Of course, the payout would be $36.00 in this case as opposed to the $9.00 payout in the prior example. As such, knowing where a player's bet is situated on a multi betting spot gaming board such as roulette is critical in determining winning bets.

Figure 7:
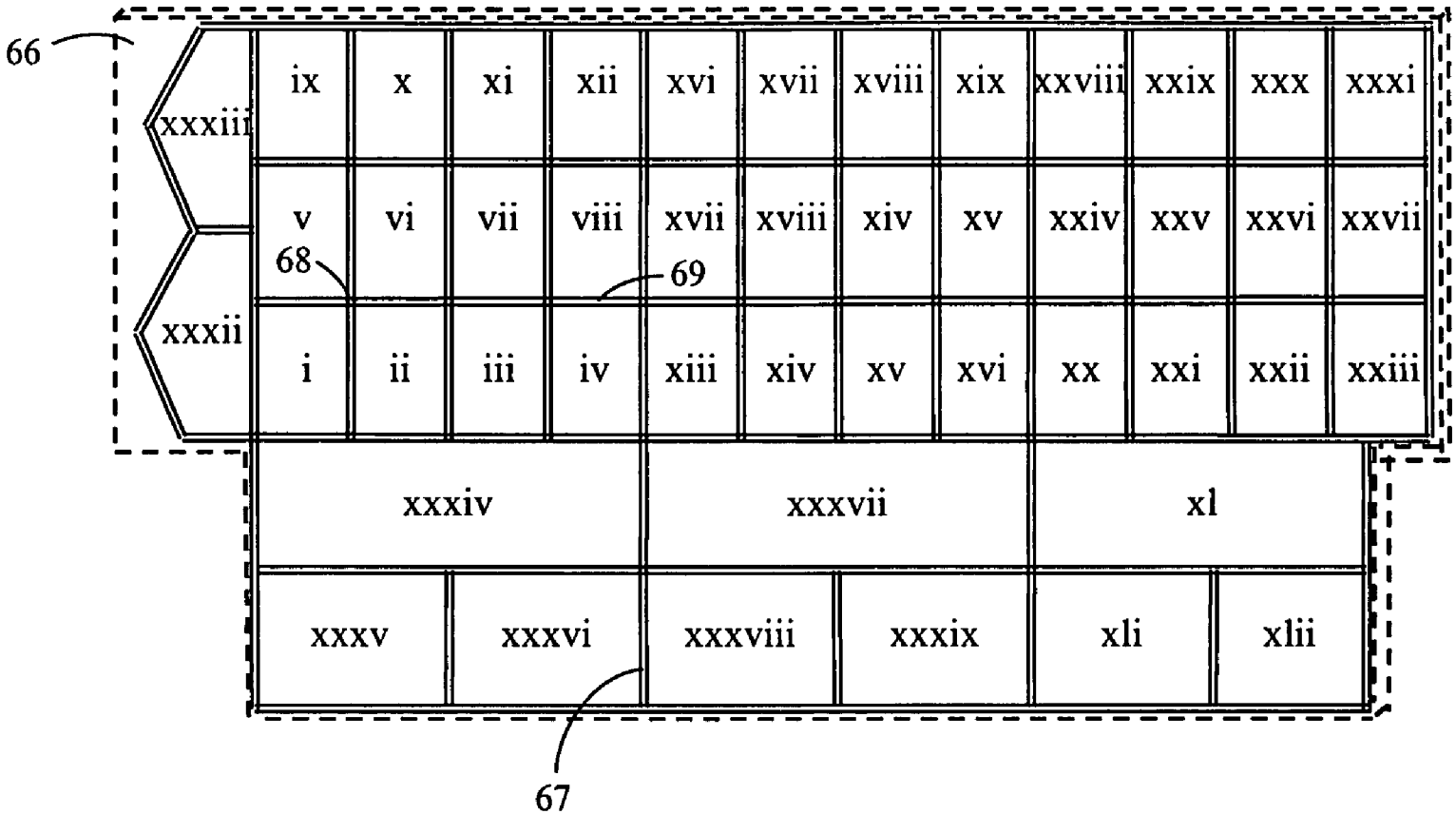
FIG. 7 is a perspective view of one embodiment of the detector of the roulette table of FIG. 6.

To this effect, FIG. 7 illustrates the detector 66 that is located under the roulette table 63 of FIG. 6. As illustrated in FIG. 7, detector 66 is sectioned into multiple quadrants consecutively numbered from i.-xlii. with position grid linings 67 sectioning each quadrant from the other. It is noteworthy that position grid linings 67 are made out of a material that will allow each of the quadrants (i.-xlii.) on detector 66 to be individually sectioned. This is used in order for the detector to be aware of the boundaries of the various betting spots on the betting board as well as enable it to locate the exact positioning of a player's betting chips on the roulette table. For example, suppose that a player places two $5.00 betting chips on the roulette table in a location that is detected by detector 66 to be on the cross sections of quadrants i., ii., v. and vi., as per reference character 68. The presence of position grid linings 67 will allow the detector to recognize that the $10.00 bet is placed on the cross sections shared between the roulette numbers that are above quadrants i., ii., v., and vi. 68, namely, numbers 1, 4, 2, and 5. As such, the detector will be able to accurately determine that the player would be entitled to a payout of 9 to 1 should the marble land on any of those stated numbers above the identified quadrants. Similarly, if the $10.00 bet was detected to be in-between quadrants viii. and iv., as indicated by reference character 69 in FIG. 7, the payout would be 18 to 1 if the marble happened to land on any of the numbers on the roulette table that are above either quadrant viii. and iv.

Figure 8:
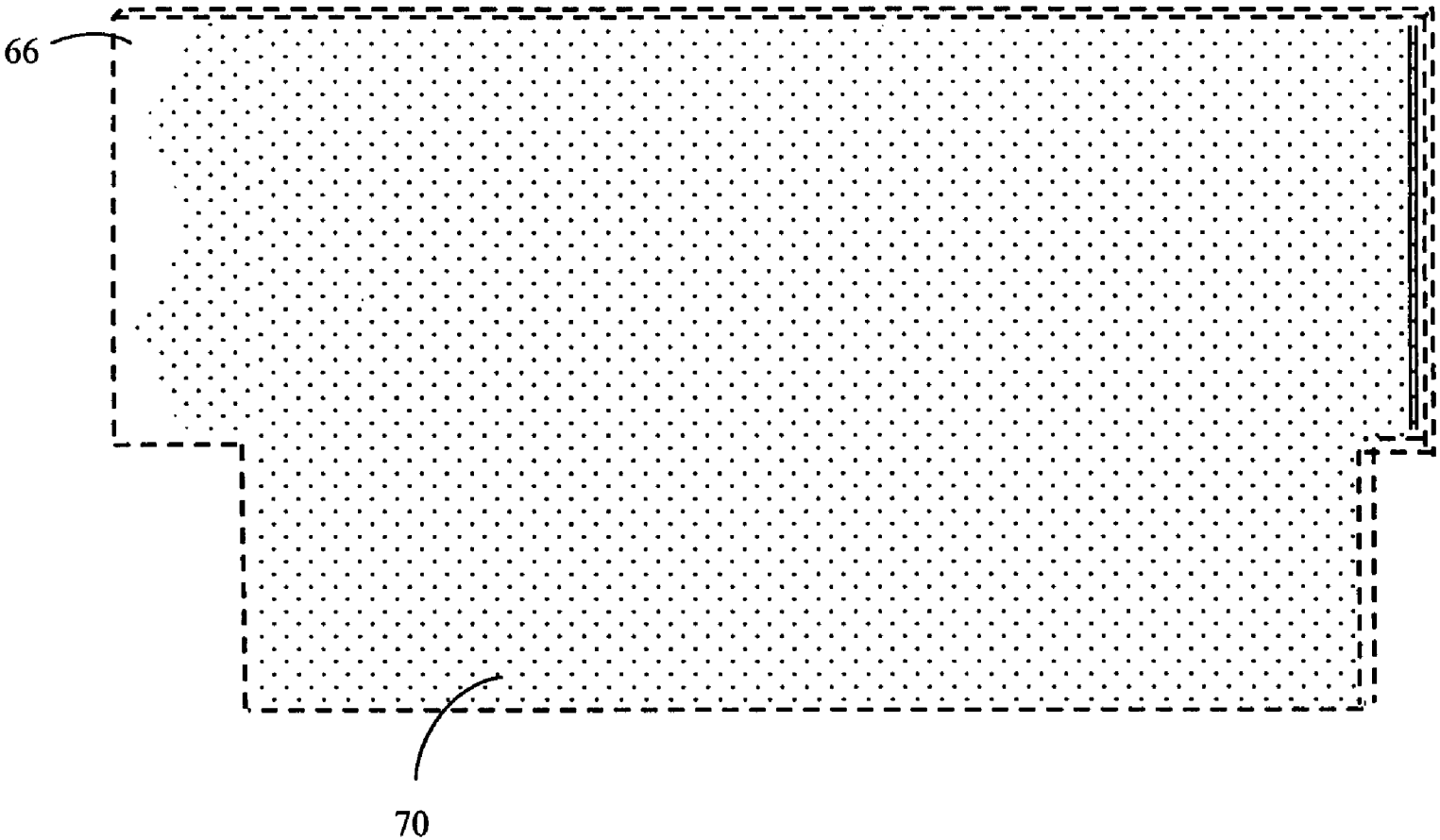
FIG. 8 is a perspective view of an alternate embodiment of the detector of the roulette table of FIG. 6.

Of course, it is further contemplated that detector 66 can be designed to detect the exact positioning of the betting chips placed on top of the roulette table without the use of position grid linings 67 or other type of sectioning mechanism. As a further example to this, detector 66 can be designed to utilize a unique coordinate layout throughout its surface, as shown in FIG. 8. There each of the marked coordinate points 70 represent a unique coordinate that is recognizable by the detector 66. Thus, when one or more betting chips are placed on top of any of the coordinate points, the detector or associated computer can automatically correlate that positioning of the betting chips with the location of the relevant betting spot(s) 65, FIG. 6, on the game board. This would allow the detector 66 to derive the exact placement of the betting chip(s) on the roulette table 63. Despite the mentioned methods of pinpointing the exact coordinates of the betting chips on a multi-betting position game table, several other methods of attaining the same may exist which are best known to those skilled in the arts, and thus, need not be elaborated upon herein.

Figure 9:
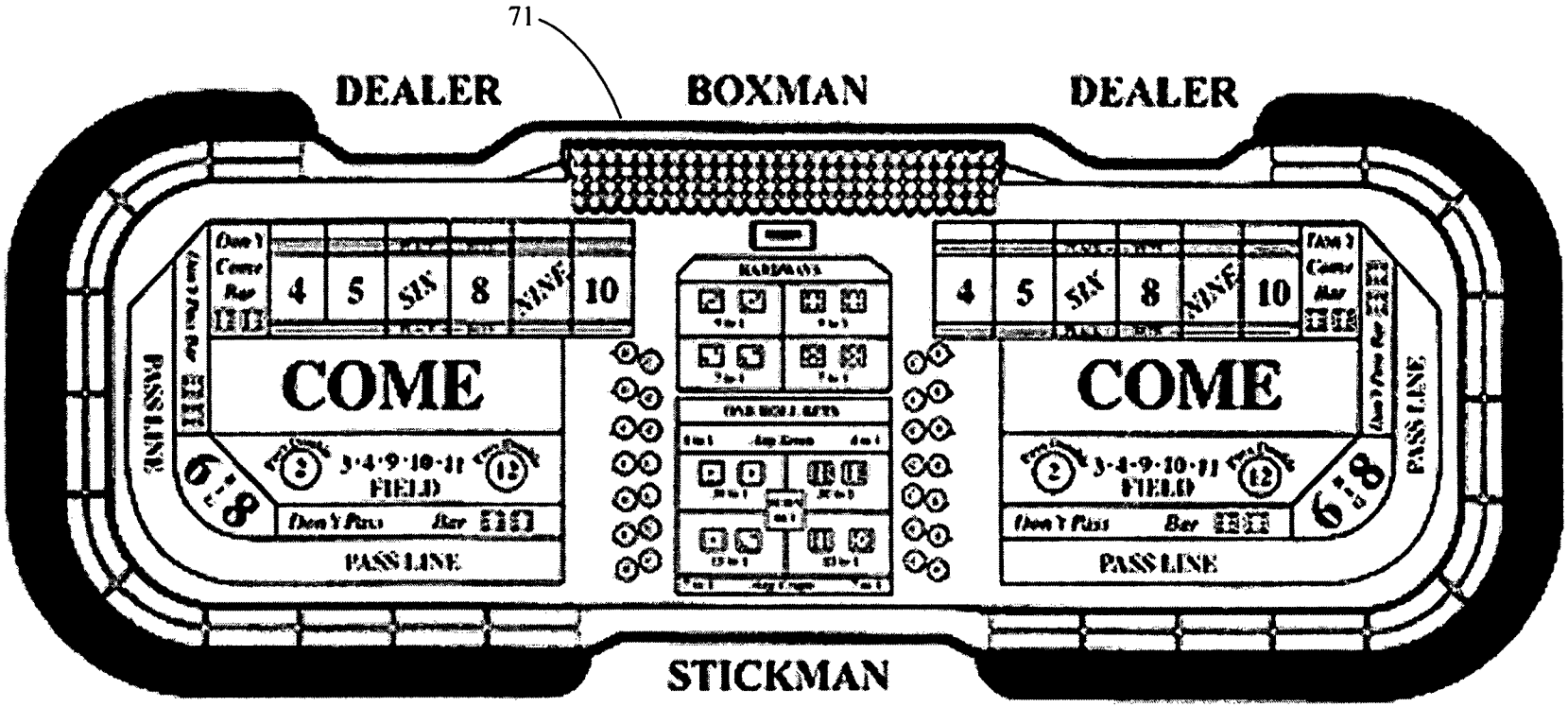
FIG. 9 is a perspective view of a craps table that may be configured in accordance with embodiments disclosed in this invention.

Similar to the roulette table of FIG. 6, a craps table, as shown in FIG. 9, may likewise utilize one uniform or multiple betting chip detectors. Since a craps table, like a roulette table also allows for multi-bet chip placements in a single gaming round, it too may utilize one or more independent detector(s) (not shown) that is able to pinpoint the exact location of the betting chips placed on the various betting spots in its betting board. Such a detector would function similar to the detector described for roulette table 63 in FIG. 6 or can vary as is best know to those skilled in the arts. See discussion above.

Figure 15:
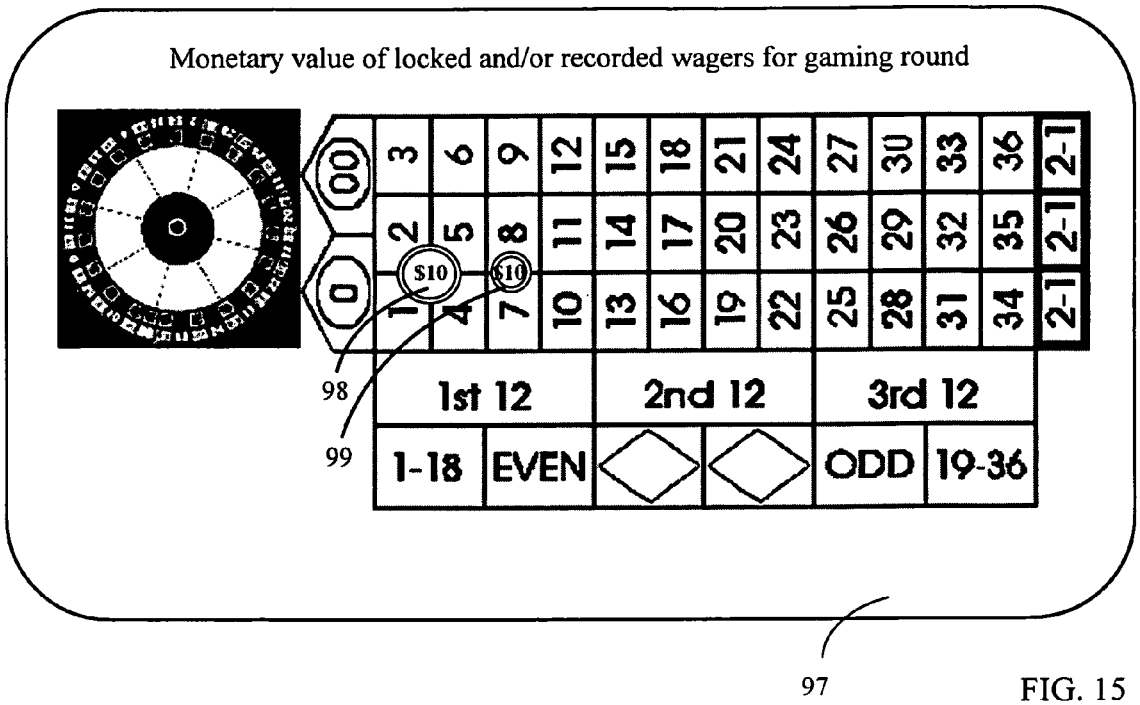
FIG. 15 is a computer screen view of the locked wagers made on gaming table which allows for simultaneous multi-position betting, wherein the location of the wagers is displayed on the table itself.
Figure 16:
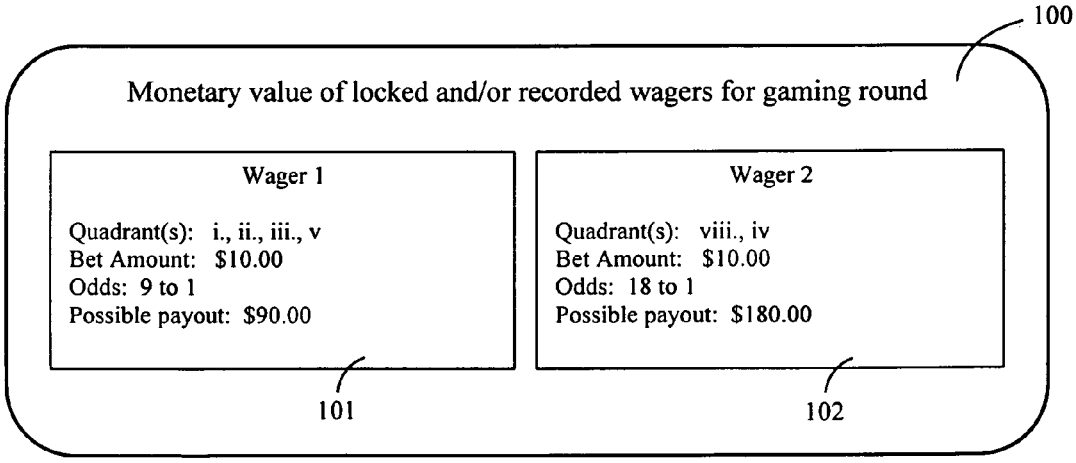
FIG. 16 is a computer screen view of the locked wagers made on gaming table which allows for simultaneous multi-position betting, wherein the wagers are displayed in accordance with a coordinate indication system.

It is noteworthy that with gaming tables, such as roulette and craps, which allow for simultaneous multi-position betting, (as well as a multitude of different players who may be positioned in various locations around the table), use of an LCD screen for each betting spot may not be feasible. In such a situation, the detectors may transmit the total value of each of the locked and/or recorded bets on the gaming table to a computer, such as computer 53 in FIG. 4 or handheld 80, FIG. 11 which may be in the position of casino personnel, such as the ones running the gaming table (i.e. the table dealer). In this respect, the computer may display a screen shot of the gaming table with the total monetary value of each bet that was placed on it positioned in the exact location of where the particular bet was made. This is shown in FIG. 15 where the total monetary value of the two bets made on the roulette table in FIG. 6 (i.e. $10.00 for each bet) are displayed on the computer screen 97 as per reference characters 98 and 99. Alternatively, the computer 54, 80 may display the total monetary value of each of the bets that was placed on the gaming table in accordance with a coordinate indication system. As shown in FIG. 16, the total monetary value of the two bets made on the roulette table in FIG. 6 and which is further elaborated upon in FIG. 7, ref. characters 68 and 68, is indicated. As displayed by the computer screen 100, a first wager of $10.00, ref. char. 101, was placed on quadrants i., ii., iii., and iv. of the roulette table detector 66 (as indicated in FIG. 7), while a second wager of $10.00, ref. char. 102, was placed on quadrants viii. and iv. The data shown on screen 100 can indicate further information such as, but not limited to the odds of payout 101, 102 as well as the possible payout amount if the player's bet is victorious 101, 102. It is noteworthy that a combination of the methods noted in FIGS. 15 and 16 or alternative configuration which is best known to those skilled in the art may be likewise used. In this manner, the casino personnel who are running the simultaneous multi-betting game would be able to pinpoint the exact location and amount of any bet that was placed on the game table after the game round was put into play.

Similar to the operation of the blackjack table, in a simultaneous multi-position betting game (e.g. roulette, craps), the exact monetary value of each of the bets made on the table (per gaming round) will be locked and/or recorded once final bets are made. Since the monetary value of all bets made per gaming round will be known by the casino personnel running the game (e.g. by way of being displayed on their computer 53), discrepancies in the value of a player's bet (in terms of actual betting chips 9) and the locked and/or recorded value of their bet will automatically indicate a possible attempt to cheat the casino. Thus, similar to the above discussion referencing the game of blackjack, dubious players in simultaneous multi-position betting games will likewise, be deterred from illicitly increasing or decreasing their bets (by secretly adding or removing chips 9) after the gaming round results are in or at any time after their bets are locked and cannot be changed.

It is further noteworthy that although this disclosure has mainly focused on gaming tables located in casinos, it is wholly contemplated the invention may be utilized with any gaming table that is situated in any location, regardless if that location is a casino or not.

Figure 10:
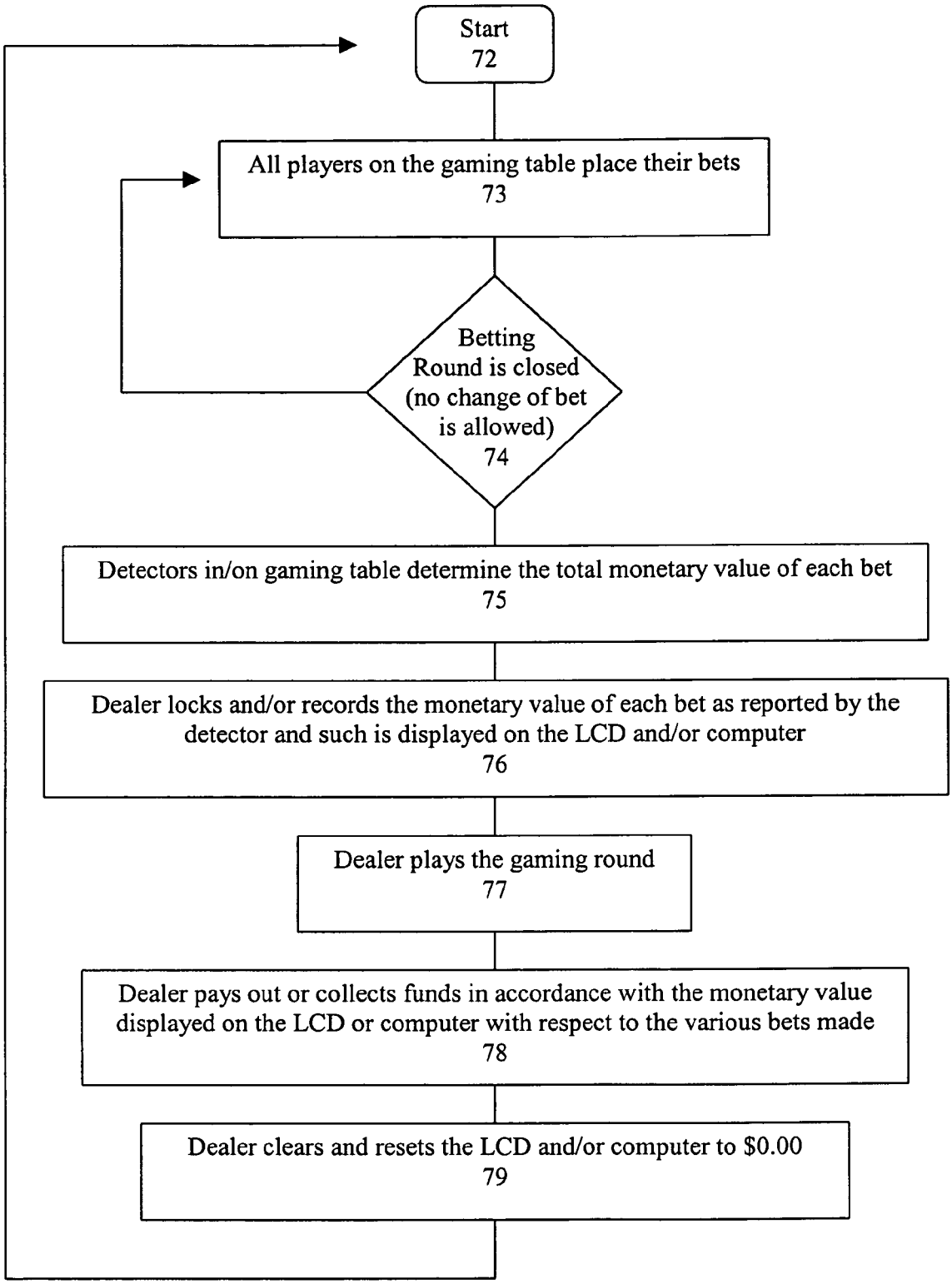
FIG. 10 is a flow chart depicting one possible way in which the disclosed invention would be used.

Finally, a flowchart shown in FIG. 10, illustrates one possible way in which the invention as disclosed herein, may be used. As shown, beginning in start block 72, all players on the gaming table place their bets for the current gaming round, block 73. After the betting time in a gaming round is closed, block 74, none of the players will be able to change their wager for the current gaming round. At this point, the detector (s) associated with the gaming table account(s) the total monetary value of each bet made, block 75 and the dealer will lock and/or record the monetary value of each of the bets placed on the gaming table, as reported by the detector. The value of the bets will thereafter be displayed to the table dealer on an LCD and/or their computer 53, 80, block 76. The dealer thereafter plays the gaming round, block 77. After the gaming round is over, the dealer pays winning bets and collects on loosing bets in accordance with the exact amounts displayed on the LCD and/or their computer 53, 80, block 78. In the event that a player's expected payout (if the player wins) or the dealer's collection of the bet (if the player looses) differs from the value displayed on the LCD or computer 53, 80, the dealer will be alerted that the player may be trying to cheat the casino and may thereafter investigate. It is noteworthy that in the event that the dealer is in on the cheating endeavor, the casino may nevertheless find out about the fraud at the same time in which the fraud occurred (if they are monitoring the gaming tables through their computer (e.g. computer 53 in FIG. 4) or at the end of a predetermined period in which the gaming table's winnings and losses are tallied in accordance with the monetary values reported by the detector and/or system 1. After all bets for the gaming round have been paid out or collected, the dealer can thereafter clear and reset the LCD and/or computer 53, 80 to $0.00, block 79, in order to initiate a new gaming round, block 72.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A method for allowing a casino game handler to verify a bet made by a player of a casino game on a gaming table at a close of betting time for a gaming round, the gaming table having a designated betting area for receiving a bet by a player, the casino game having rules restricting a player from changing the player's bet after a predetermined close of betting time, said method comprising the steps of:

a) allowing a player to place a bet upon the designated betting area of the gaming table before the betting time has closed;

b) using a betting chip detector to detect the monetary value of the bet placed upon the designated betting area of the gaming table by the player and creating an electrical representation of such detected monetary value;

c) requiring the casino game handler to generate a locking signal at approximately the predetermined close of betting time, and before the gaming round is played;

d) locking the electrical representation of such detected monetary value of the bet placed upon the designated betting area by the player in response to the generation of the locking signal;

e) providing the locked electrical representation of such detected monetary value of the bet to a display device; and f) displaying the locked monetary value of such bet to the casino game handler on the display device after the betting time has closed.

2. The method of claim 1 including the step of providing a computer proximate to the casino game handler for displaying the locked monetary value of said bet to the casino game handler.

3. The method of claim 2 including the step of electronically displaying the locked monetary value of such bet to said player.

4. The method of claim 1 wherein the casino game is played in a plurality of gaming rounds, said method including the further step of zeroing out the locked monetary value of said bet before performing the detecting step b) during each gaming round.

5. The method of claim 1 including the further step of the casino game handler electronically signaling a request to adjust the locked monetary value of a player's bet after the betting time has closed, and before the end of a gaming round.

6. The method of claim 5 including the further steps of using a computer to compare the adjustment requested by the casino game handler to predetermined casino game procedures to determine whether the requested adjustment is authorized by such casino game procedures.

7. The method of claim 5 wherein the detecting step and locking step are repeated to lock the monetary value of an adjusted bet after the casino game handler requests an adjustment to the locked monetary value of a player's bet.

8. The method of claim 7 including the further step of the casino game handler overriding the locked monetary value of said adjusted bet to effect a further adjustment requested by the player.

9. The method of claim 7 including the further step of creating a warning signal if the detected monetary value of a bet placed upon the designated betting area differs from the locked value of said adjusted bet.

10. The method of claim 1 including the further step of the casino game handler overriding the locked monetary value of a player's bet to effect an adjustment requested by the player.

11. The method of claim 1 including the further step of creating a warning signal if the detected monetary value of a bet placed upon the designated betting area differs from the locked value of said bet after the close of the betting time.

12. The method of claim 1 including the step of transmitting statistical data relating to said bet made by said player at said gaming table to a central computer remote from said gaming table.

13. The method of claim 12 including the step of manually inputting said statistical data into said central computer.

14. The method of claim 12 including the step of automatically inputting said statistical data into said central computer.

15. The method of claim 1 including the step of displaying the locked monetary value of such bet to said player after the betting time has closed.

16. The method of claim 15 including the step of electronically displaying the locked monetary value of such bet to said player on a data display.

17. The method of claim 1 wherein the casino game is a card game, and wherein the gaming round is played when any cards are dealt on the gaming table for such gaming round.

18. The method of claim 1 wherein the casino game is a game using dice, and wherein the gaming round is played when any die is tossed on the gaming table for such gaming round.

19. The method of claim 1 wherein the casino game is roulette, and wherein the gaming round is played when a marble first contacts one of the numbered slots on a roulette wheel for such gaming round.

20. A method for detecting attempted fraud by a player of a casino game on a gaming table, the gaming table having a designated betting area for receiving a bet by a player, the casino game having rules prohibiting a player from changing the player's bet after a predetermined close of betting time, said method comprising the steps of:

a) allowing a player to place a bet upon the designated betting area of the gaming table before the betting time has closed;

b) using a betting chip detector to detect the monetary value of the bet placed upon the designated betting area of the gaming table by the player and creating an electrical representation of such detected monetary value;

c) requiring the casino game handler to generate a locking signal at approximately the predetermined close of betting time;

d) locking the electrical representation of such detected monetary value of the bet placed upon the designated betting area by the player in response to the generation of the locking signal;

e) comparing the monetary value of the bet currently within the designated betting area of the gaming table after the predetermined close of betting time to the locked monetary value at the predetermined close of betting time; and f) creating a warning signal if the monetary value of the bet currently within the designated betting area of the gaming table after the predetermined close of betting time differs from the locked monetary value at the predetermined close of betting time during a gaming round.

21. The method of claim 20 wherein the locked monetary value of said bet is electronically displayed to said game handler on a data display.

22. The method of claim 21 including the step of locating said data display proximate to said gaming table.

23. The method of claim 20 wherein the casino game is a card game, and wherein the predetermined close of betting time for a particular gaming round occurs before any cards are dealt on the gaming table for such gaming round.

24. The method of claim 20 wherein the casino game is a game using dice, and wherein the predetermined close of betting time for a particular gaming round occurs before any dice are tossed on the gaming table for such gaming round.

25. The method of claim 20 wherein the casino game is roulette, and wherein the predetermined close of betting time for a particular gaming round occurs before a marble begins to fall into any numbered slots on a roulette wheel for such gaming round.

26. The method of claim 20 including the further step of the casino game handler electronically signaling a request to adjust the locked monetary value of a player's bet after the betting time has closed, and before the end of a gaming round.

27. The method of claim 26 including the further steps of using a computer to compare the adjustment requested by the casino game handler to predetermined casino game procedures to determine whether the requested adjustment is authorized by such casino game procedures.

28. The method of claim 26 wherein the detecting step and locking step are repeated to lock the monetary value of an adjusted bet after the casino game handler requests an adjustment to the locked monetary value of a player's bet.

29. The method of claim 28 including the further step of the casino game handler overriding the locked monetary value of said adjusted bet to effect a further adjustment requested by the player 30. The method of claim 28 including the further step of creating a warning signal if the detected monetary value of a bet placed upon the designated betting area differs from the locked value of said adjusted bet.

31. The method of claim 20 including the further step of the casino game handler overriding the locked monetary value of a player's bet to effect an adjustment requested by the player.

32. A gaming table for allowing a casino game handler to verify a bet made by a player of a casino game on the gaming table at a close of betting time for a gaming round, the casino game having rules restricting a player from changing the player's bet after a predetermined close of betting time, the gaming table comprising:

a) at least one designated betting area for receiving a bet by a player before the betting time has closed;

b) at least one detector for detecting the monetary value of the bet placed upon the designated betting area of the gaming table by the player and creating an electrical representation of such detected monetary value;

c) a locking signal actuator operated by the casino game handler to generate a locking signal at approximately the predetermined close of betting time, and before the gaming round is played;

d) a storage element responsive to the locking signal for locking the electrical representation of such detected monetary value of the bet placed upon the designated betting area by the player at the close of the betting time; and e) a data display proximate to the gaming table and associated with the storage element for displaying the locked monetary value of such bet to the casino game handler after the betting time has closed.

33. The gaming table of claim 32 wherein said data display also displays the locked monetary value of such bet to said player after the betting time has closed.

* * * * *